United States Patent [19]

Sayles

[11] 4,078,953

[45] Mar. 14, 1978

[54] REIGNITION SUPPRESSANTS FOR SOLID EXTINGUISHABLE PROPELLANTS FOR USE IN CONTROLLABLE MOTORS

[75] Inventor: David C. Sayles, Huntsville, Ala.

[73] Assignee: The United States of America as represented by the Secretary of the Army, Washington, D.C.

[21] Appl. No.: 614,390

[22] Filed: Sep. 17, 1975

[51] Int. Cl.[2] ..... C06B 45/10

[52] U.S. Cl. ..... 149/19.4; 149/20

[58] Field of Search ..... 149/194, 20, 113, 114, 149/110, 76

[56] References Cited

U.S. PATENT DOCUMENTS

| | | | |
|---|---|---|---|
| 3,476,622 | 11/1969 | Harada et al. | 149/19.4 X |
| 3,632,458 | 1/1972 | Filter et al. | 149/19.4 X |
| 3,830,672 | 8/1974 | Listo | 149/19.4 X |

*Primary Examiner*—Edward A. Miller

*Attorney, Agent, or Firm*—Nathan Edelberg; Robert P. Gibson; Jack W. Voigt

[57] ABSTRACT

A selected polybromocompound, when added in an amount from about 1.0 to about 3.0 weight percent to a controllable solid propellant composition, is effective as a reignition suppressant without having detrimental effects on the ballistic properties of the propellant. The mechanism for accomplishing these desired results consists of sweeping away the combustible exhaust products from the propellant's extinguished surface by the non-combustible decomposition gases of a polybromocompound which is selected from diammonium tetrabromophthalate, tetrabromophthalimide, and N-substituted tetrabromophthalimide.

2 Claims, No Drawings

REIGNITION SUPPRESSANTS FOR SOLID EXTINGUISHABLE PROPELLANTS FOR USE IN CONTROLLABLE MOTORS

DEDICATORY CLAUSE

The invention described herein may be manufactured, used, and licensed by, or for, the Government for governmental purposes without the payment to me of any royalties thereon.

BACKGROUND OF THE INVENTION

In the field of controllable solid propellant rocket motors which employ extinguishable propellants, additives have been used to aid extinguishment, and to suppress spontaneous reignition of the propellant. Extinguishable propellants are capable of undergoing extinguishment when the motor pressure is rapidly reduced. Such extinguishment can be made to occur before all of the propellant has been consumed.

Propellants intended for controllable motor application must possess certain properties that are not normally desirable in conventional solid propellants. These include a high burning rate exponent (*n*); a high critical pressure (P*cr*), below which the motor cannot sustain steady-state operating pressure; a high pressure deflagration pressure (P*dl*), below which combustion will not occur; and a high threshold ignition pressure (P*th*), below which propellant reignition will not occur upon exposure to a given heat flux.

In addition to these special properties, the ballistic and mechanical properties of current state-of-the-art propellants are wanted. These properties include: ease and economy of manufacture, high specific impulse, mechanical properties suited to case bonding, adequate insensitivity and stability characteristics, and good aging characteristics.

Extinguishable propellants fall into three general classes: (1) those containing conventional composite binders and low energy oxidizers, such as, potassium perchlorate and flame suppressants, such as, sodium fluoride; (2) composite propellants using fluorocarbon binders; and (3) conventional composite or double-base binders filled with high contents of nitramine-type oxidizers, such as, RDX and HMX.

The conventional composite propellants containing $KClO_4$ are of low impulse and produce large concentrations of alkali metal ions—and, as a consequence, a significant radar signature in their exhausts. If their specific impulse is improved through increased solids loading, standard processing techniques cannot be used.

The fluorocarbon propellant systems use expensive, non-commercially-available ingredients; have not been adequately characterized with regard to mechanical properties, and current fluorocarbon systems of developmental interest exhibit low elongation and poor case bondability.

The prior art technology has generally relied on the use of low energy oxidizers ($KClO_4$), flame suppressants (NaFl), and coolants (dihydroxyglyoxime), oxamide, ammonium dihydrogen phosphate, ammonium tetrahydrogen metaphosphate, ammonium hexafluorophosphate, etc. to achieve extinguishment in controllable propellant motor applications.

In my copending application titled: "Fire-Retardant Insulation for Rocket Motors," Ser. No. 563,427, filed Mar. 31, 1975, it was disclosed that tetrabromophthalic anhydride (TBPA) and tetrabromophthalimide (TBPI), their salts and derivatives (when employed either as additives to the inert components when these inert components are being compounded or as crosslinking agents for these inert components) impart fire-retardancy characteristics to these inert components (liner, insulation, slivers, etc.). These components undergo afterburning (combustion of the gases which are produced by the pyrolysis of the inert components with the air ingested into the rocket motor due to the free convective circulation after motor burnout). The fire-retardance characteristics desired for the inert components was achieved by employing from about 10 to about 20 weight percent of the TBPA or TBPI.

The advantages of a reignition suppressant additive for use in solid, extinguishable propellants would be quite attractive if the desirable ballistic properties would not be offset. These suppressants involve a new mechanism for extinguishment, i.e., sweeping away of the combustible exhaust products from the propellant surface by non-combustible gases.

Therefore, an object of this invention is to provide an improved controllable propellant composition that includes a reignition suppressant which effectively raises the pressure deflagration limit, and which provides a source of non-combustible gases for sweeping away of combustible exhaust products from an extinguished propellant.

SUMMARY OF THE INVENTION

It has been discovered that a controllable propellant which has the critical characteristics of high burning rate, high pressure exponent, and good extinguishability can be benefitted by inclusion of an effective amount of a polybromocompound which functions as a reignition suppressant. An effective amount is from about 1.0 weight percent to about 3.0 weight percent with a preferred effective amount being about 1.0 weight percent. An amount in excess of 3 weight percent produces little further beneficial effect. Therefore, the suggested range in weight percent of the propellant composition is the preferred range since any additional beneficial effect could possibly be offset by a loss of propellant performance or loss of ballistic properties. The preferred amount of the polybromocompound is about 1.0 weight percent with a preferred particle size of about 10 micrometers.

The improved controllable propellant composition of this invention contains blended ammonium perchlorate oxidizer (fine and porous), aluminum metal fuel, polyurethane binder, Silon S (silica), and a polybromocompound selected from diammonium tetrabromophthalate, tetrabromophthalimide, and N-substituted tetrabromophthalimide. The Silon S is a trade name for silica which functions to promote uniform combustion stability, and also acts as a burning rate accelerator since it serves as a decomposition catalyst for the ammonium perchlorate.

DESCRIPTION OF THE PREFERRED EMBODIMENT

The controllable propellant composition of this invention contains from about 1.0–3.0 weight percent of a polybromocompound selected from diammonium tetrabromophthalate, tetrabromophthalimide, and N-substituted tetrabromophthalimide, blended ammonium perchlorate (about 50–60 weight percent fine particle size and about 8–12 weight percent porous), aluminum metal fuel about 15–20 weight percent, about 0.4 to 0.6 weight percent of a decomposition accelerator for AP which is Silon S (<1-micrometer) silica, and about 12–15 weight percent polyurethane binder.

A comparison of a controllable propellant B containing diammonium tetrabromophthalate with a controllable propellant A containing the prior art extinguishment aid, ammonium dihydrogen phosphate, is presented in Table I.

TABLE I

A COMPARISON OF CONTROLLABLE PROPELLANTS

| COMPOSITION | PROPELLANT A | PROPELLANT B |
|---|---|---|
| Ammonium Perchlorate (8-micrometer) | 22.0 | 22.0 |
| Ammonium Perchlorate (3-micrometer) | 33.0 | 33.0 |
| Porous Ammonium Perchlorate (180-micrometer) | 10.0 | 10.0 |
| Aluminum (95-micrometer) | 18.0 | 18.0 |
| Flake Aluminum (Alcoa-609) | 1.0 | 1.0 |
| Ammonium Dihydrogen Phosphate (12-micrometer) | 1.0 | — |
| Diammonium Tetrabromophthalate (10-micrometer) | — | 1.0 |
| Silon S* (<1-micrometer) (Decomposition Accelerator) | 0.5 | 0.5 |
| Polyurethane Binder | 14.5 | 14.5 |
| BALLISTIC CHARACTERISTICS | | |
| Specific Impulse (1000/14.7 psi) (0°) (lbf-s/lbm) | 249 | 250 |
| Density (Specific weight) (lb/in$^3$) | 0.0626 | 0.064 |
| Burning Rate (at 2000 psi) (ips) | 2.8 | 2.8 |
| (100-2000 psi) (strands) | 0.95 | 0.90 |
| Pressure Deflagration Limit ($\Delta\rho$=10-psi/s | 10 | 110 |
| C* Efficiency (%) | 98 | 99 |
| Motor /L* (psi/in) | 75/500 | 150/500 |
| Pe | 45/800 | 95/800 |
| MECHANICAL PROPERTIES | | |
| Tensile Stress (ps) | 136 | 140 |
| Strain at Maximum Stress (%) | 26 | 30 |
| Strain at Break (%) | 29 | 33 |
| Modulus (psi) | 745 | 850–900 |

*Silica

Diammonium tetrabromophthalate serves a dual function in propellant B, namely, promoting extinguishability and reducing spontaneous ignition.

The effectiveness of the diammonium tetrabromophthalate in diminishing the tendency of the controllable propellant to undergo spontaneous reignition is attributed to the suppression of the ammonium perchlorate's 300° C exotherm (as derived from Differential Thermal Analysis); minimum interference with the crosslinker-binder cure reaction, and the increased thermal stability of the propellant (as determined by exposing a 1-inch propellant cube at 350° C).

The increase or lack of change in the dimensions of the cube can be used as the indicator of the thermal stability of the propellant. Thermal stability is of special concern in controllable propellant compositions to avoid spontaneous reignition. The polybromocompounds of this invention are effective in minimizing premature reignition of the extinguished propellant by the mechanism of reducing propellant outgassing after extinguishment.

I claim:

1. A controllable propellant composition comprising:
(i) ammonium perchlorate oxidizer blend of fine ammonium perchlorate in an amount from about 50 to about 60 weight percent of said controllable propellant composition and of porous ammonium perchlorate in an amount from about 8 to about 12 weight percent of said controllable propellant composition;
(ii) aluminum metal fuel in an amount from about 15 to about 20 weight percent of said controllable propellant composition;
(iii) a polyurethane binder in an amount from about 12 to about 15 weight percent of said controllable propellant composition;
(iv) silica of particle size less than 1 micrometer which functions as a decomposition accelerator for ammonium perchlorate in an amount from about 0.4 to about 0.6 weight percent of said controllable propellant composition; and,
(v) a polybromocompound as a reignition suppressant selected from diammonium tetrabromophthalate, tetrabromophthalimide, and N-substituted tetrabromophthalimide in an amount from about 1.0 to about 3.0 weight percent of said controllable propellant composition.

2. The controllable propellant composition of claim 1 wherein said ammonium perchlorate blend is present in an amount of about 55 weight percent of fine ammonium perchlorate that is comprised of about 22 weight percent of fine ammonium perchlorate of about 8 micrometer particle size and of about 33 weight percent of fine ammonium perchlorate of about 3 micrometer particle size; said aluminum metal fuel is present in an amount of about 19 weight percent with about 18 weight percent aluminum of about 95 micrometer particle size and of about 1 weight percent of flake aluminum; said polyurethane binder is present in an amount of about 14.5 weight percent; said silica is present in an amount of about 0.5 weight percent; and said polybromocompound selected is diammonium tetrabromophthalate of about 10 micrometer particle size which is present in an amount of about 1.0 weight percent.

* * * * *